United States Patent [19]

Hageman

[11] Patent Number: 4,599,258

[45] Date of Patent: Jul. 8, 1986

[54] IN SITU ROOFING COMPOSITE AND METHOD

[76] Inventor: John P. Hageman, 42 Susan Dr., Closter, N.J. 07624

[21] Appl. No.: 715,286

[22] Filed: Mar. 25, 1985

Related U.S. Application Data

[63] Continuation-in-part of Ser. No. 642,576, Aug. 20, 1984, Pat. No. 4,521,478.

[51] Int. Cl.[4] ..... B32B 3/10; B32B 5/02

[52] U.S. Cl. ..... 428/140; 156/71; 428/139; 428/141; 428/143; 428/281; 428/282; 428/283; 428/291; 428/489

[58] Field of Search ..... 428/139, 140, 141, 143, 428/281, 282, 283, 291, 489, 480, 491; 156/71

[56] References Cited

U.S. PATENT DOCUMENTS

| | | | |
|---|---|---|---|
| 3,094,447 | 6/1963 | Chamberlain | 428/489 |
| 3,135,069 | 6/1964 | Schuller et al. | 428/139 |
| 3,369,956 | 2/1968 | Schultz | 428/281 |
| 3,369,958 | 2/1968 | Fleeman | 428/282 |
| 3,466,222 | 9/1969 | Curtis | 428/489 |
| 3,672,951 | 6/1972 | Moore et al. | 428/489 |
| 3,967,032 | 6/1976 | Plotz et al. | 428/489 |
| 4,136,223 | 1/1979 | Harder | 428/139 |
| 4,230,762 | 10/1980 | Iwasaki et al. | 428/287 |
| 4,233,353 | 11/1980 | Bondoc et al. | 428/141 |

*Primary Examiner*—Paul J. Thibodeau
*Attorney, Agent, or Firm*—Robert S. Salzman

[57] ABSTRACT

The invention comprises a built-up roof composite that is used upon seamed roof substrates. The composite has a membrane that is simultaneously formed and affixed to a base sheet adhered to the roof substrate. The membrane comprises a sheet of heat-resistant, non-woven polyester sandwiched between layers of asphalt. The upper asphalt layer is caused to flow through the polyester and meld with the lower layer of asphalt to form a homogeneous membrane.

20 Claims, 4 Drawing Figures

IN SITU ROOFING COMPOSITE AND METHOD

RELATED APPLICATION

This application is a continuation-in-part of parent application Ser. No. 642,576; filed: Aug. 20, 1984; now U.S. Pat. No. 4,521,478; issued: June 4, 1985.

FIELD OF THE INVENTION

This invention relates to roofing construction materials and methods, and more particularly to an improved in situ roofing composite and method of fabricating same.

BACKGROUND OF THE INVENTION

In recent times, the use of asphalt-impregnated polyester sheet for roofing construction has been found to provide excellent results. The polyester sheeting is generally treated with asphalt and other water-resistant materials in the factory, because of the difficulties experienced with applying water-proofing materials to the polyester at the roof site.

Untreated, non-woven polyester sheet does not generally withstand heat, and does not easily absorb hot asphalt.

Untreated, polyester sheet has been used with asphalt in cold-process roofing systems, wherein the asphalt is modified with latex or polypropylene and sprayed in a cold liquid state upon the polyester sheet. The cold process roofing systems have not been entirely satisfactory, because they tend to remain tacky for many months. This tackiness hinders the completion, repair and/or inspection of the roof, since the roof cannot be walked upon while tacky.

Even where hot asphalt systems have been contemplated with the use of polyester sheet, the asphalt generally requires torching on the roof, which is an unsafe, fire-hazardous procedure.

Therefore, most roofing applications using polyester materials have been with a polyestermat, i.e., a factory asphalt-impregnated polyester sheet.

The drawback of using factory impregnated polyester sheeting, however, is the high cost and inconvenience of shipping and handling these heavy rolls of material.

The present invention contemplates the construction of a roof using a polyester-hot asphalt or coal tar process at the roofing site, without the aforementioned disadvantages.

Hot, built-up roofing can now use plain, non-woven polyester sheet for the reasons that the polyester is now being manufactured with a resin treatment that assists the polyester to withstand the temperature (450 degrees F) of hot asphalt and other hot-applied water-proofing ingredients.

In addition, torching the asphalt on the roof is no longer necessary with the advent of a new hot pumping system, wherein the asphalt is pumped in a hot fluid state to the roof.

The advantages of building-up a roof with hot water-proofing ingredients and polyester sheeting are many.

The rolls of plain, non-woven polyester sheet are light in weight and inexpensive to purchase and ship.

Plain polyester rolls are easier to work with, and a single, light-weight ply is often all that is required to produce an efficacious roof construction.

According to this invention, the polyester and asphalt layers can be melded together and simultaneously directly attached to the roof substrate as a composite membrane. This inventive method of forming and affixing a composite membrane simultaneously, in situ, not only reduces the costs of fabrication, but also provides a roof of better quality and adhesion.

The inventive method and construction will be explained in more detail, hereinafter.

The composite membrane technique of this invention can be used with different roof substrates and overlays of foam, such as polyurethane and isocyanurate, to provide a roof composite construction of exceptional durability.

Where roof substrates are comprised of seams, it has been found that asphalt will leak into the seams. An additional base sheet must be provided below the polyester sheet to maintain a given quantity of water-proofing ingredients to form the composite membrane, i.e. enough asphalt must be provided below the polyester sheet in order to rise through the polyester and meld with the asphalt placed above the polyester sheet. The base sheet is first adhered to the roof substrate using a thin layer of asphalt. The polyester and asphalt composite is then applied over the base sheet, as previously described in U.S. patent application Ser. No. 704,143; filed: Feb. 21, 1985.

DISCUSSION OF RELATED ART

The use of a woven polyester sheet for cold process roof systems using an emulsion of latex and asphalt is shown in German Pat. No. 2200881. This technique is not similar to this invention in that a cold process is used rather than a hot process, and a woven rather than a non-woven sheet of polyester is utilized. Such a system using an asphalt emulsion will remain tacky, and as such, is not practical.

In the U.S. Pat. No. 4,230,762, issued to Iwasaki et al; on Aug. 15, 1978, a non-woven fabric which is impregnated at the factory with asphalt, is described. This patent does not suggest using a plain, unpregnated polyester sheet in situ. As previously described, factory impregnated material is expensive to ship due to the added weight, and is further difficult to handle.

In U.S. Pat. No. 3,369,958, issued to H. Fleeman on Feb. 20, 1968, an embossed sheet of polythene or polyvinyl chloride is suggested as a material which can withstand the heat generated by hot asphalt roofing techniques. This patent does not suggest the specific use of polyester sheeting. Also, this patent does not suggest the flow of asphalt through the sheet to form a composite membrane, and one which can be directly applied in one step.

BRIEF SUMMARY OF THE INVENTION

This invention features a built-up, in situ roofing composite applied upon roof substrates having seams. The composite has a membrane that is affixed to a base sheet adhered to the roof substrate. The membrane is formed and affixed to the base sheet in a single, simultaneous step.

The roofing composite in toto comprises a first layer of water-proofing ingredients applied to the roof substrate. The ingredients can be selected from a group consisting of asphalt, modified asphalt and coal tar.

Over the first layer a base sheet is applied. The base sheet is generally a material selected from a group consisting of: asbestos, fiberglass, paper, felt, non-permeable polyester, and organic base sheet. The organic base sheet comprises wood pulp and paper and sometimes cotton rag. Over the base sheet is laid a second layer of water-proofing ingredients. Over the second layer at least a single ply of non-woven polyester sheeting is laid. The polyester sheet has an approximate weight in the range of 4 to 14 ounces per square yard. Preferably, the polyester has a weight of approximately 5.5 to 7.5 ounces per square yard.

A third layer of water-proofing ingredients is applied over the polyester. The third layer of ingredients is allowed to flow through the polyester and meld with the second layer, thus forming a built-up composite membrane that is affixed to the base sheet which is adhered to the roof substrate.

Over the membrane composite is applied a heat resistant layer of material, such as gravel, foam or a layer of mastic followed by granules. The foam may be a polyurethane or an isocyanurate. Similarly, the roof substrate may comprise a foam.

The polyester sheet may be embossed prior to its installation to give the sheeting improved suppleness and adhesion.

The composite roofing made in the above manner exhibits a durability uncommon with present day techniques and is substantially split-resistant.

It is an object of the invention to provide an improved roof composite and method of fabricating same for use upon seamed roof substrates.

It is another object of this invention to provide a roof composite that includes a membrane that is simultaneously formed and affixed to a base sheet adhered to the roof substrate.

These and other objects of the invention will be better understood and will become more apparent with reference to the subsequent detailed description considered in conjunction with the accompanying drawings.

DETAILED DESCRIPTION OF THE INVENTION

Generally speaking, the invention features a built-up, in situ roofing composite, wherein a water-proof membrane is simultaneously formed and affixed to a base sheet that is adhered to a seamed roof substrate.

Figure 1:
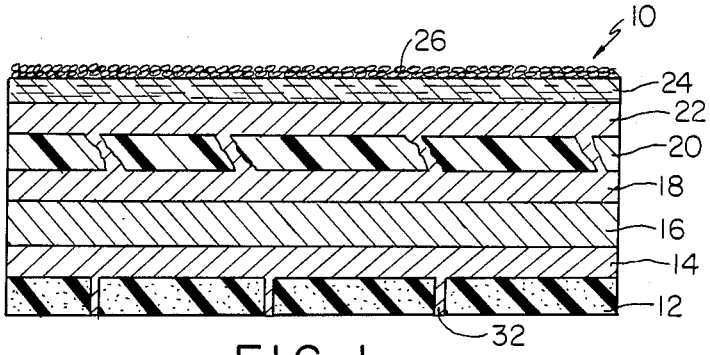
FIG. 1 is an exaggerated sectional view of the improved roof composite of this invention.
Figure 1A:
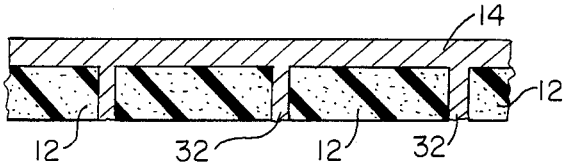
FIG. 1A is a sectional view of a seamed roof substrate in which the overlay of asphalt is caused to penetrate.

Referring to Figure 1A, a roof substrate 12 is shown, wherein the substrate is laid in blocks or sheets having seams 32.

When hot asphalt is applied in a layer 14 over the substrate 12, some of the asphalt will tend to run into the seams 32, causing a thinning of the asphalt layer 14 above it. When this happens, the subsequent application of a polyester sheet and an additional asphalt layer will not provide a well formed composite membrane, as described in the previous patent application, U.S. Ser. No. 642,576, filed: Aug. 20, 1985; and now U.S. Pat. No. 4,521,478; issued: June 4, 1985.

The composite membrane will not form as planned, because there may not be sufficient asphalt in layer 14 to meld with the asphalt applied over the polyester sheet. In order to overcome this drawback, the present improved composite contemplates the application of a base sheet 16 (FIGS. 1–3) of generally nonpermeable material, which is adhered to the substrate 12 by the layer 14 of asphalt. To this base sheet 16, is then applied the composite membrane as described in the previous U.S. application Ser. No. 642,576; filed: Aug. 20, 1984, now U.S. Pat. No. 4,521,478; issued June 4, 1985.

The total improved composite and method of its fabrication will be described with reference to FIGS. 1 through 3, wherein like elements have been assigned the same designation for the sake of brevity.

Now referring to FIG. 1, a roof composite 10 attached to a porous or seamed roof substrate 12 is illustrated in an exaggerated sectional view. The composite 10 is made up of several layers of materials, the first of which is a layer of asphalt 14. The asphalt can be applied in a temperature range of between 350 degrees F. to 480 degrees F. depending on the type of asphalt used, i.e., dead level, flat or steep. Modified asphalt (treated with latex) as well as coal tar may be used for the layer 14.

The first layer 14 of asphalt is mopped over the seamed substrate 12 and is spread out in a quantity of about 20 to 30 lbs. per square foot by a hot spreader or by mopping.

Over this first asphalt layer 14, a base sheet 16 is laid. The base sheet 16 is preferably laid over the asphalt layer 14, while the asphalt is still hot, so that upon cooling, the base sheet 16 will be firmly adhered to the roof substrate 12.

The roof substrates contemplated by this invention are board stock having seams generally delineating 2'×4' or 4'×8' blocks. The substrate materials can be foams, such as the polyurethanes or isocyanurates, manufactured by the Upjohn Company.

Expanded pearlete can also be used as a substrate 12, made by the Great Lakes Carbon Corporation.

Phenolic foams of the type made by Koppers of Pittsburgh, under the trade name XTRA can also be used as a material for roof substrate 12.

Composite materials such as urethane and fiberglass; or pearlite and urethane, manufactured by Upjohn Co. or Celotex are also contemplated for the above purpose.

The base sheet 16 can be fiberglass material manufactured by Owens-Corning of Toledo, Ohio; an organic base sheet comprising wood pulp and paper, and sometimes cotton rag, made by Owens-Corning and Celotex of Tampa, Fla.

Other base sheet materials can be paper, felt, asbestos and a precoated, non-permeable polyester sheet.

The base sheet 16 may be applied over the asphalt layer 14 by a machine that rolls the sheet into the asphalt.

Over the base sheet 16 is then applied a second, and heavier layer of asphalt 18. About 50 pounds per square foot of asphalt is used for layer 18.

Preferably all the asphalt used in this invention is steep asphalt. The asphalt is heated to 450 degrees F. in a temperature-controlled bulk tanker. The tanker keeps the asphalt at a constant temperature, critical for successfully applying polyesters.

Using a bulk tanker also enables the crew to start the job as soon as they get to the site, rather than having to wait for the asphalt to heat up. It provides a steady supply of hot asphalt, keeping production rates high. Plus, the tanker eliminates smoke and fumes, is safer than kettles, and uses less propane.

The asphalt is pumped up to an asphalt spreader or a small hot lugger. A mechanic spreads the hot asphalt of layer 18 with a mop.

Over the asphalt layer 18 is disposed a layer 20 of resin-treated, non-woven polyester. The resin treatment allows the polyester to withstand the heat of the asphalt.

As the asphalt is mopped onto the base sheet 16, another worker unrolls a 50 lb. roll of the polyester sheeting into the asphalt layer 18.

Another worker then covers the polyester sheet layer 20 with another 50 pounds per square feet of asphalt, thus forming layer 22. The asphalt 22 is allowed to penetrate the polyester layer 20.

The polyester sheet is 68 mils thick, so it requires a lot of asphalt to fill the polyester layer 20.

The asphalt layer 22 is broomed into the polyester layer 20 to ensure good penetration. The asphalt is broomed sideways across the polyester, so that the polyester is not stepped on by the worker, and the underlayers of asphalt 14 and 18 are not displaced.

The penetrating asphalt layer 22 melds with the underlayer 18 and then rises back up through the polyester layer 20.

When the asphalt layer 22 is "broomed-in," a polyester and asphalt composite membrane is simultaneously formed and securely attached to the base sheet 16 which is adhered to the roof substrate 12.

The asphalt layer 22 must be shielded from the harmful ultraviolet rays of the sun. Also, the polyester layer 20 must be kept cool. Therefore, a heat-resistant insulating layer is required over the asphalt layer 22. FIGS. 1 through 3 shows three different ways of covering the membrane composite.

FIG. 1 illustrates a first method wherein a mastic layer 24 is coated over asphalt layer 22, and then a layer of ceramic granules 26 is embedded in the mastic layer 24.

The mastic layer 24 comprises asphalt in a solvent, such as mineral spirits. Asbestos or fiberglass may be added to the mastic composition.

The granules 26 are poured into a ground-level machine manufactured by Kold-King of Denver, Colo. that pumps them to the roof and sprays them over the mastic layer 24.

Figure 2:
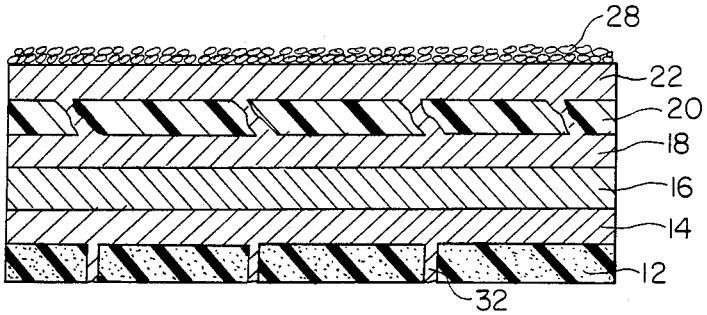
FIG. 2 is an exaggerated sectional view of an alternate embodiment of the roof composite shown in FIG. 1.

In FIG. 2, a layer 28 of gravel is directly applied on top of the asphalt layer 22.

Figure 3:
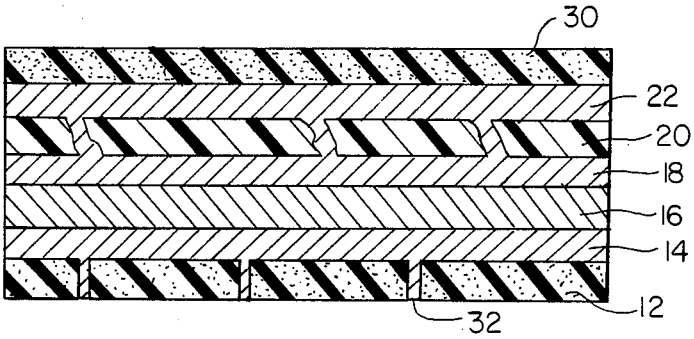
FIG. 3 is an exaggerated sectional view of another alternate embodiment of the roof composite illustrated in FIG. 1.

In FIG. 3, a layer 30 of foam is applied over the asphalt layer 22. The foam can be a polyurethane or an isocyanurate made by the Upjohn Company.

The foam in layer 30 can be sprayed or applied in blocks or sheets.

The polyester sheeting can be laid in single, double or triple ply. The polyester sheet can range in weight from 4 to 14 ounces per square yard.

The resin-treated non-woven polyester sheet is made by the Hoechst Company, New Jersey under the trade name of Trivera ®.

Another polyester sheet that can be used in hot-roofing systems is made by Du Pont Co. of Wilmington, Del., called Reemay Hot. This sheet is a polyester and fiberglass laminate.

The granules 26 are type 11 made by the 3 M Company of Bellmede, N.J. Granules can also be purchased from GAF Corporation.

The mastic can be purchased from the Monsey Corporation of East Rutherford, N.J.

The asphalt can be purchased from the Exxon Corporation.

The roof composite of this invention is substantially split-resistant. This is very significant, since the major cause of failure in contemporary roofing is splitting.

Having thus described the invention, what is desired to be protected by Letters Patent is presented by the subsequently appended claims.

What is claimed is:

1. A built-up, in situ roofing composite applied upon a roof substrate having seams, comprising:

a first layer of water-proofing ingredients selected from a group consisting of asphalt, modified asphalt and coal tar;

a base sheet applied over said first layer;

a second layer of water-proofing ingredients applied over said base sheet;

at least one ply of non-woven polyester sheeting overlaying said second layer of water-proofing ingredients;

a third layer of water-proofing ingredients applied over said polyester sheeting, said third layer melding with said second layer to form a composite with said polyester sheeting; and an insulating, heat-resistant layer of material disposed over said built-up composite membrane forming a roofing composite that is substantially split-resistant.

2. The built-up, in situ roofing composite of claim 1, wherein said base sheet includes materials selected from a group consisting of: fiberglass, paper, asbestos, non-permeable polyester, felt, and organic base sheet.

3. The built-up roofing composite of claim 1, wherein said insulating layer comprises a material selected from a group consisting of-gravel, granules and heat-resistant foam.

4. The built-up roofing composite of claim 2, wherein said foam comprises a polyurethane.

5. The built-up roofing composite of claim 2, wherein said foam comprises an isocyanurate.

6. The built-up roofing composite of claim 1, wherein said roofing substrate comprises heat-resistant foam.

7. The built-up roofing composite of claim 2, wherein said foam comprises a polyurethane.

8. The built-up roofing composite of claim 2, wherein said foam comprises an isocyanurate.

9. The built-up roofing composite of claim 1, wherein said polyester has a weight in a range of approximately 4 to 14 ounces per square yard.

10. The built-up roofing composite of claim 9, wherein said polyester has a weight in an approximate range of 5.5 to 7.5 ounces per square yard.

11. The built-up roofing composite of claim 1, wherein said polyester is embossed.

12. The built-up roofing composite of claim 2, wherein said insulating material comprises granules, and further comprising a layer of mastic disposed between said second layer and said granules.

13. A built-up, in situ roofing composite applied to a roof substrate having seams, comprising:

a first layer of asphalt applied to a roof substrate;

a base sheet applied over said first layer;

a second layer of asphalt applied to said base sheet;

at least a single ply of non-woven polyester sheeting overlaying said first layer;

a third layer of asphalt applied over said polyester, said third layer flowing through said polyester and melding with said second layer to form a built-up composite membrane which is affixed to said base sheet which is adhered to the roof substrate; and an insulating, heat-resistant layer of material disposed over said built-up composite membrane, said insulating layer including a layer of mastic covered by granules.

14. A method of fabricating in situ, a roofing composite, applied over a roof substrate having seams, comprising the steps of:

(a) applying a first layer of water-proofing ingredients to a roof substrate;

(b) overlaying said first layer with a base sheet;

(c) applying a second layer of water-proofing ingredients to said base sheet;

(d) overlaying said second layer with at least a single ply of polyester sheeting;

(e) applying a third layer of water-proofing ingredients over said polyester and brooming said ingredients into said polyester sheeting;

(f) causing said third layer of water-proofing ingredients to flow through said polyester and meld with said second layer of water-proofing ingredients to form a composite membrane which is affixed to said substrate; and (g) covering said composite membrane with a heat-resistant insulating layer.

15. The method of claim 14, wherein said water-proofing ingredients comprise asphalt, and wherein said applying step (e) includes brooming said asphalt upon said polyester, said asphalt being in a temperature range of approximately 350 degrees F. to 480 degrees F.

16. The method of claim 14, wherein said covering step (g) includes applying a layer of gravel over said composite membrane.

17. The method of claim 14, wherein said covering step (g) includes applying a layer of mastic upon said composite membrane and overlaying said mastic with granules.

18. The method of claim 14, wherein said covering step (g) includes spraying a layer of heat-resistant foam over said composite membrane.

19. The method of claim 14, wherein said roof substrate includes a foam material.

20. The method of claim 14, wherein said base sheet includes materials selected from a group consisting of: fiberglass, paper, asbestos, non-permeable polyester, felt, and organic base sheet.

* * * * *